US006669392B2

(12) United States Patent
Rebora

(10) Patent No.: US 6,669,392 B2
(45) **Date of Patent: *Dec. 30, 2003**

(54) DEVICE FOR BINDING SHEETS AND BOUND SHEETS

(75) Inventor: Francesco Rebora, Genoa (IT)

(73) Assignee: Prima S.r.l. (IT)

( * ) Notice: Subject to any disclaimer, the term of this patent is extended or adjusted under 35 U.S.C. 154(b) by 127 days.

This patent is subject to a terminal disclaimer.

(21) Appl. No.: 09/862,796

(22) Filed: May 22, 2001

(65) Prior Publication Data

US 2002/0023553 A1 Feb. 28, 2002

Related U.S. Application Data

(63) Continuation of application No. PCT/IT99/00385, filed on Nov. 24, 1999.

(30) Foreign Application Priority Data

Nov. 24, 1998 (IT) ..... TO98A0988

(51) Int. Cl.[7] ..... B42F 13/02

(52) U.S. Cl. ..... 402/8; 281/21.1; 402/16; 402/18; 402/73; 412/38

(58) Field of Search ..... 402/8, 14, 15, 402/16, 17, 18, 73; 412/38, 40; 281/15.1, 21.1

(56) References Cited

U.S. PATENT DOCUMENTS

| | | | | | |
|---|---|---|---|---|---|
| 2,206,394 | A | * | 7/1940 | Farkas | 281/27.1 |
| 3,956,798 | A | * | 5/1976 | Wright | 281/27.1 |
| 4,174,909 | A | * | 11/1979 | Jahn | 402/13 |
| 4,375,925 | A | * | 3/1983 | Grummich | 402/15 |
| 4,601,489 | A | * | 7/1986 | Stancato | 281/21.1 |
| 5,895,190 | A | * | 4/1999 | Viola | 412/40 |
| 6,168,337 | B1 | * | 1/2001 | Adams | 402/8 |

FOREIGN PATENT DOCUMENTS

| | | |
|---|---|---|
| EP | 0 304 411 | 2/1989 |
| FR | 749 885 | 7/1933 |

* cited by examiner

*Primary Examiner*—Monica Carter
(74) *Attorney, Agent, or Firm*—Akerman Senterfitt

(57) ABSTRACT

A device for binding sheets in a pack, the device having a flat rectangular sheet element (3) in turn having, along one major side (3*a*), a number of flexible tongues (7) arranged combfashion; and a closing strip (10) extending along the major side (3*a*). The strip (10) has an application surface (13) facing the tongues (7) and having a layer of adhesive (17). The flat element (3) is placeable on a first face of the pack, with the tongues (7) inserted inside the respective holes (33) formed along one edge of the pack, and with respective ends (7*e*) of the tongues (7) projecting from the holes. The closing strip (10) is foldable and placeable with the layer of adhesive (17) superimposed on a flat element (30*b*) defining a second face of the pack (30).

16 Claims, 5 Drawing Sheets

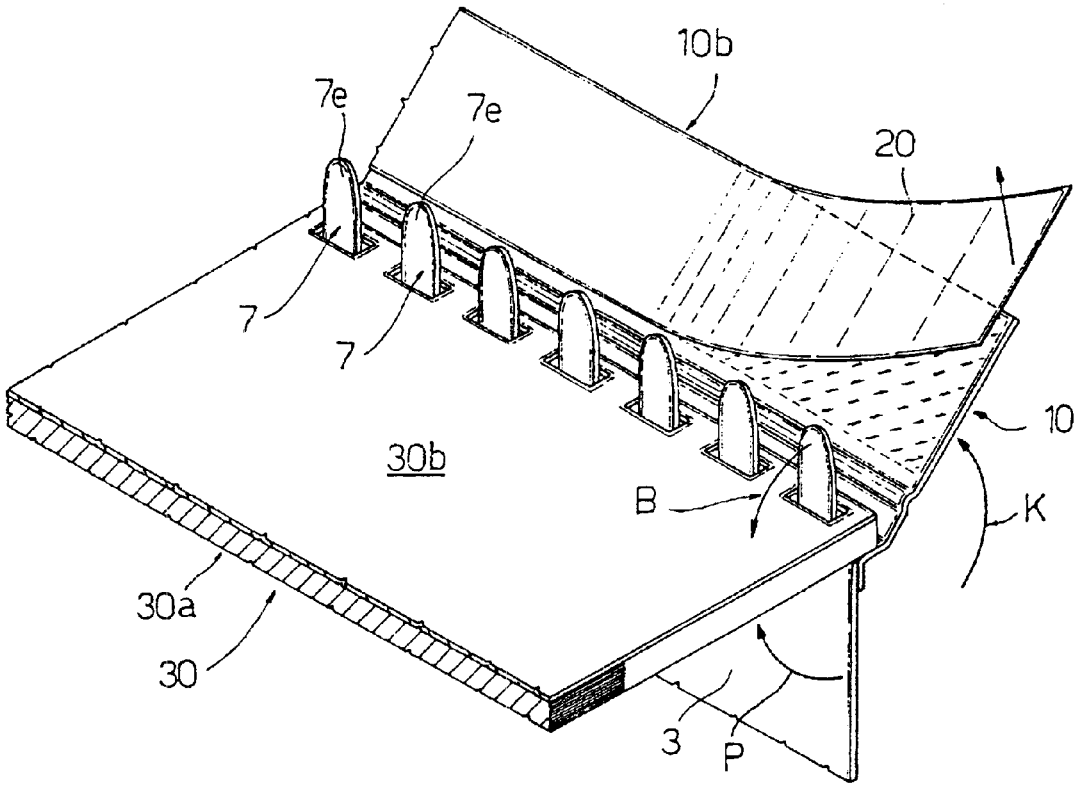
Fig.6
Fig.7
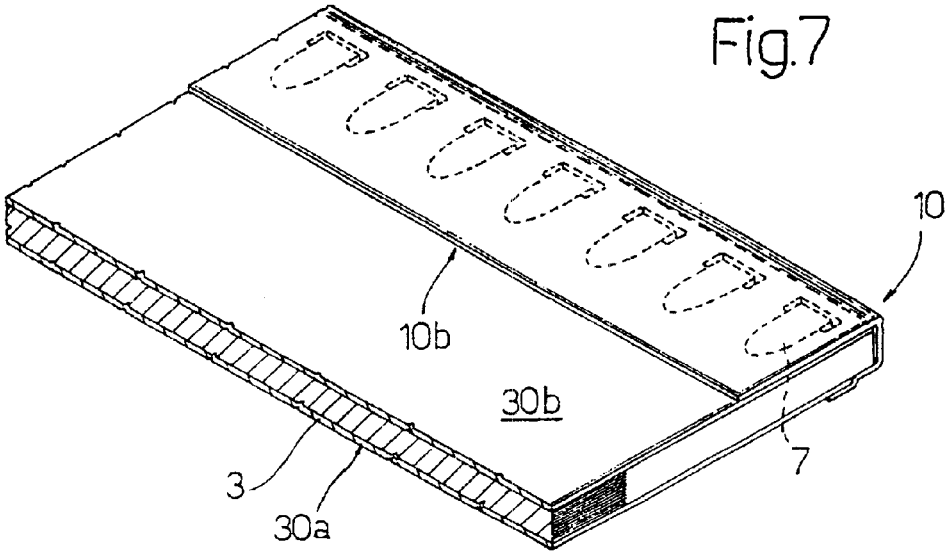

DEVICE FOR BINDING SHEETS AND BOUND SHEETS

CROSS-REFERENCE TO RELATED APPLICATIONS

This is a continuation of PCT International Application No. PCT/IT99/00385, filed Nov. 24, 1999.

TECHNICAL FIELD

The present invention relates to a device for binding sheets in a pack, and to a bound bundle.

BACKGROUND ART

As is known, packed sheets with holes along one edge of the pack are bound using substantially tubular binding devices comprising an elongated, substantially C-section spine portion, and a number of curved tongues formed integrally with the spine portion and spaced to form an elastic comblike structure. Each tongue is inserted inside a respective (preferably rectangular) hole in the pack and through the pack so that a respective end portion rests on an inner surface of the spine portion to firmly connect and bind the sheets into a bundle.

Known binding devices of the above type have a number of drawbacks, including the following:

the elongated spine portion projects frontwards and laterally from the bundle, so that the bundle is often difficult to shelve or place alongside other bound bundles;

binding devices of different sizes, in particular with elongated spine portions of different shape and width, are required for binding bundles of different thickness;

writing or printing is not normally possible on the spine of the bound bundle, by the spine being defined by the outer surface of the spine portion, which is curved and made of plastic material;

the binding device (being made of plastic material) must be detached from the packed sheets when disposing of, e.g. burning, the bundle.

DISCLOSURE OF INVENTION

It is an object of the present invention to provide a device for binding packed sheets, designed to eliminate the drawbacks of known devices.

According to the present invention, there is provided a binding device of the type described in claim 1.

The present invention also relates to a bound bundle of the type described in claim 16.

BRIEF DESCRIPTION OF THE DRAWINGS

A non-limiting embodiment of the invention will be described by way of example with reference to the accompanying drawings, in which:

FIG. 6 shows a view in perspective of a second stage in the use of the binding device;

FIG. 7 shows a view in perspective of a third stage in the use of the binding device;

BEST MODE FOR CARRYING OUT THE INVENTION

Figure 1:
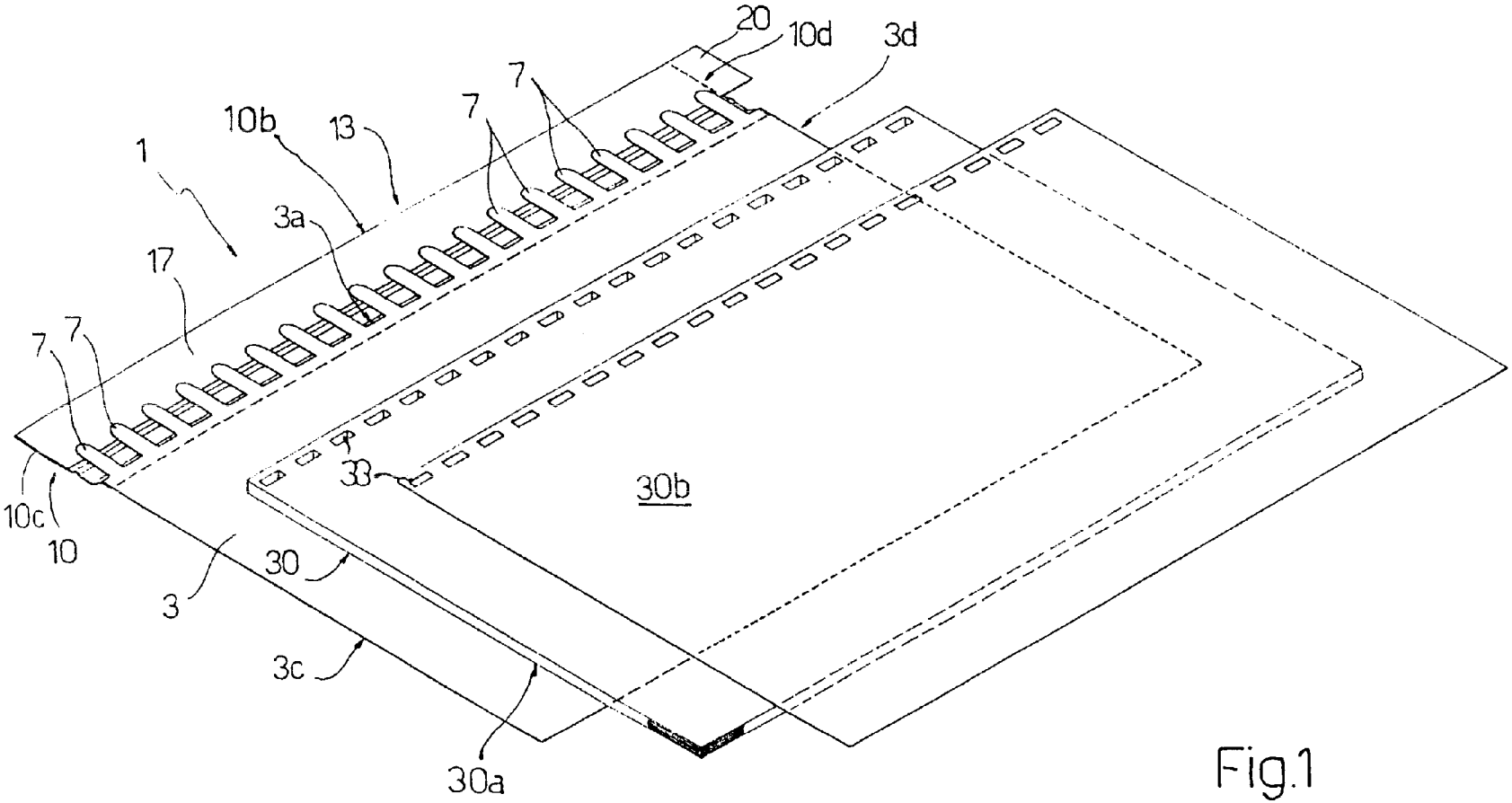
FIG. 1 shows a view in perspective of a binding device in accordance with the teaching of the present invention.

Number 1 in FIG. 1 indicates as a whole a binding device comprising a rectangular flat sheet element 3 having a number of flexible tongues 7 arranged combfashion along a straight major side 3*a*. Tongues 7 are preferably die-cut integrally with flat sheet element 3.

Flat sheet element 3 may be formed by die-cutting a sheet of cardboard, a sheet of plastic material (e.g. transparent plastic material), or a sheet of metal (e.g. a flexible sheet of aluminium). That is, flat sheet element 3 may be made of various materials, providing sufficient flexibility of tongues 7 is ensured.

Figure 2:
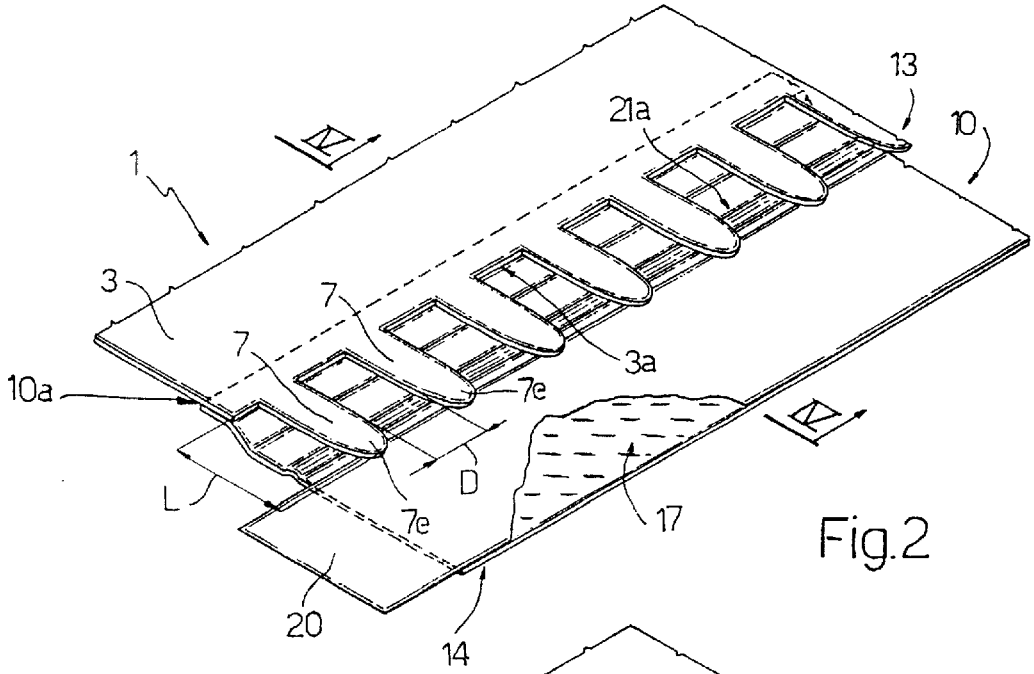
FIG. 2 shows a larger-scale view in perspective of a portion of the FIG. 1 binding device.

Tongues 7 are equally spaced with spacing D (FIGS. 2 and 3) along straight major side 3*a,* and are all of the same length L; and each tongue 7 extends perpendicularly to side 3*a,* and is rectangular with a rounded minor-side free end 7*e.*

Figure 4:
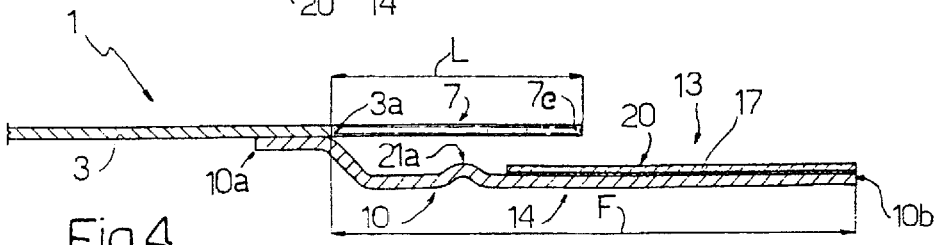
FIG. 4 shows a section along line IV—IV in FIG. 2.

Binding device 1 also comprises a strip-shaped closing element 10 extending along the whole of straight major side 3*a* of flat element 3, and preferably made of the same material as flat element 3. More specifically, closing strip 10 is rectangular, and comprises a first straight major edge portion 10*a* (FIG. 4) glued to flat sheet element 3 along straight major side 3*a;* and two minor edges 10*c,* 10*d* (FIG. 1) aligned with the minor sides 3*c,* 3*d* of rectangular flat element 3.

Closing strip 10 has an application surface 13 facing tongues 7, and a surface 14 facing away from tongues 7.

Application surface 13 has an adhesive strip 17 extending along a second straight major edge portion 10*b* of strip 10. Adhesive strip 17 comprises a removable cover strip 20, and is preferably defined by a biadhesive strip along straight major edge lob of closing strip 10.

Adhesive strip 17 may also be normally solid and formable thermally; in which case, cover strip 20 may be dispensed with.

Closing strip 10 (FIG. 4) has a useful width F (measured between second edge portion 10*b* and side 3*a*) greater than the length L of each tongue 7, so that the end portion 7*e* of each tongue faces application surface 13 when strip 10 is undeformed and substantially flat. Closing strip 10 may also be made of cloth.

Closing strip 10 also has a preferential bend line 21*a* (FIG. 2) extending the whole length of the closing strip and parallel to major edges 10*a* and 10*b* of strip 10 and to side 3*a* of flat sheet element 3. Preferential bend line 21*a* extends along a portion of surface 13 not covered with adhesive.

Figure 3:
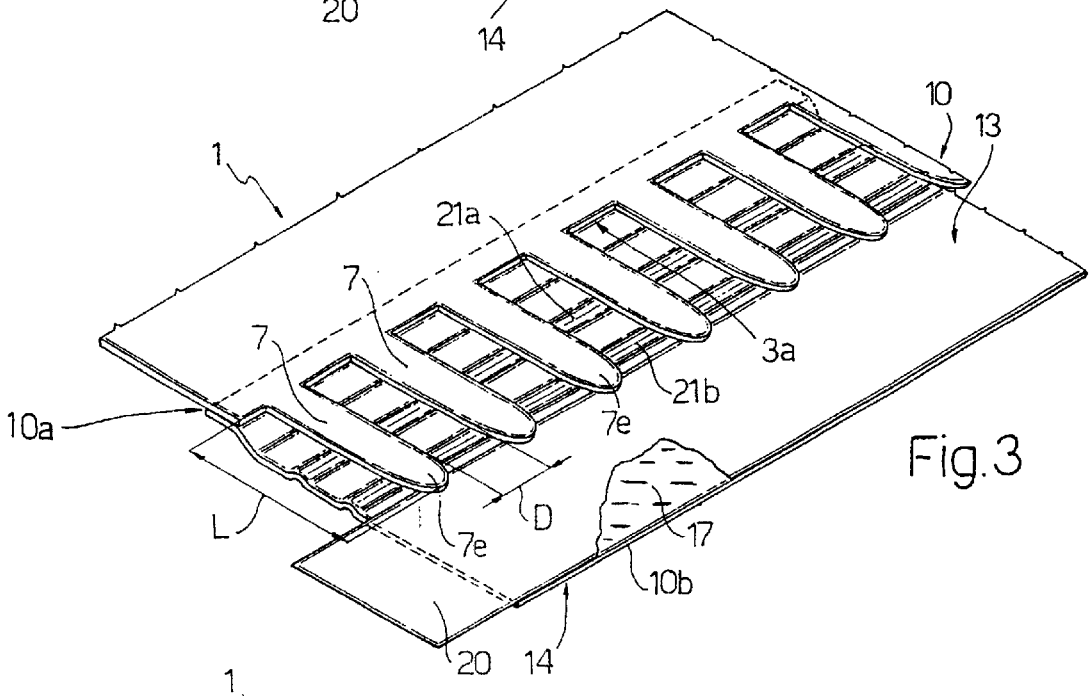
FIG. 3 shows a variation of the FIG. 2 binding device.

A larger number of bend lines may be provided, e.g. two (or more) as shown in FIG. 3, which shows two preferential bend lines 21*a,* 21*b* extending parallel to major edges 10*a* and 10*b* of strip 10 and therefore parallel to side 3*a* of flat sheet element 3. Both preferential bend lines 21*a,* 21*b* extend along a portion of surface 13 not covered with adhesive.

Figure 5:
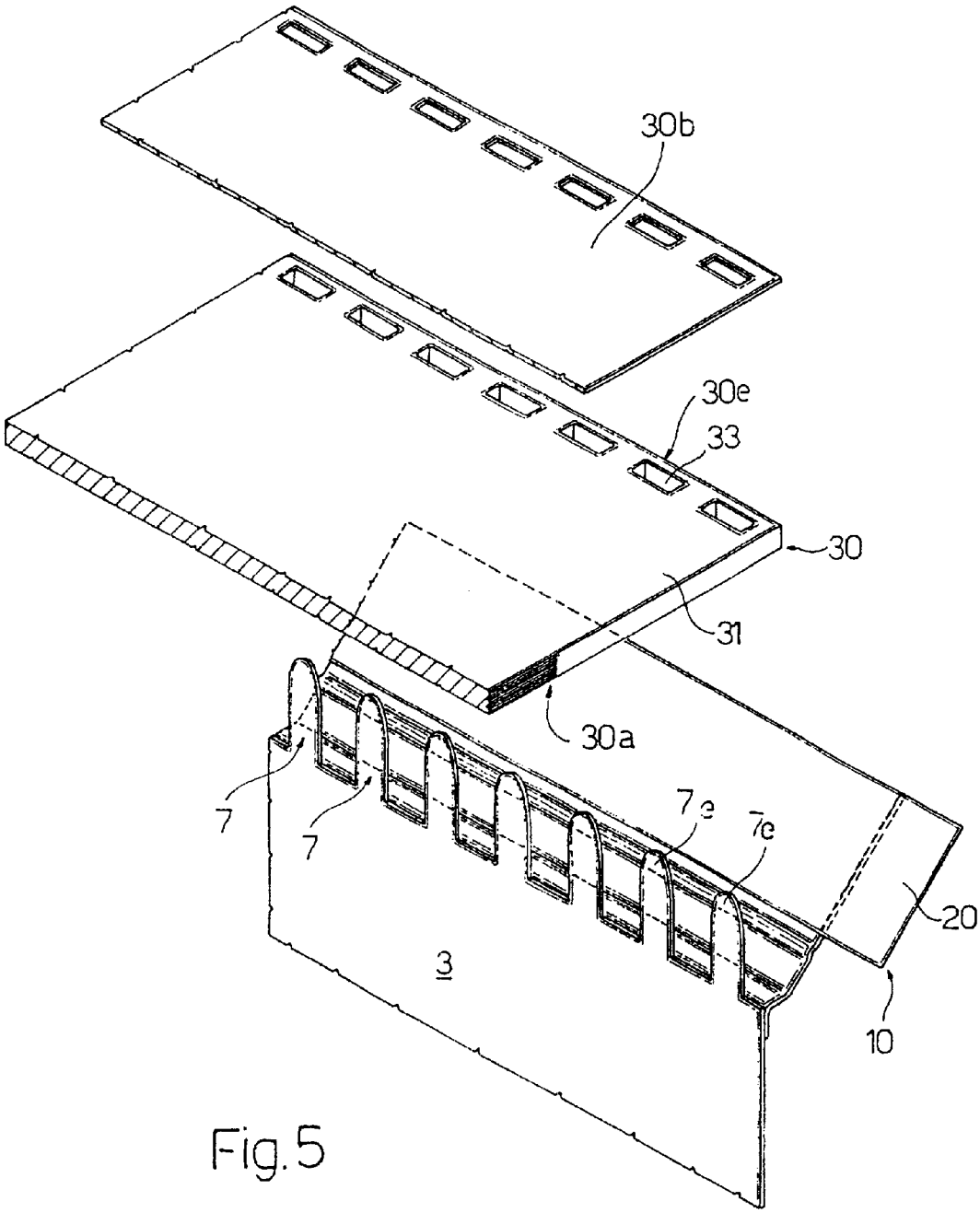
FIG. 5 shows a view in perspective of a first stage in the use of the binding device.

To use the device according to the present invention, a pack 30 (FIGS. 1 and 5) is prepared of rectangular sheets 31 having a series of rectangular-section holes 33 extending along a straight major edge 30*e* of pack 30. Pack 30 is defined, on opposite faces, by flat end elements 30*a,* 30*b* preferably defined by a sheet and by a semirigid element (e.g. cardboard, as shown in FIG. 1). In FIGS. 5 and 1, flat element 30*b* is shown detached from the other parts of pack 30 for the sake of clarity.

According to the present invention, each tongue 7 is inserted through a respective hole 33 in pack 30 so that each end 7*e* projects from hole 33 (FIGS. 5 and 6). This may be done manually (FIGS. 5 and 6) by placing flat sheet element 3 vertically with tongues 7 facing upwards, placing pack 30 horizontally and perpendicular to tongues 7, and at the same time moving pack 30 towards tongues 7 so as to insert the tongues inside respective holes 33 (FIG. 6). At this point, flat sheet element 3 is folded (arrow P) onto a first face of pack 30. More specifically, flat element 3 is folded onto flat end element 30*a* of pack 30, with tongues 7 still inserted inside holes 33 and with pack 30 in the preceding position (for instance still horizontal), so as to bend tongues 7 at their respective bases.

The ends of tongues 7 projecting from pack 30 are then bent (arrow B) onto flat end element 30*b* (preferably made of semirigid material) defining a second face of pack 30.

Figure 8:
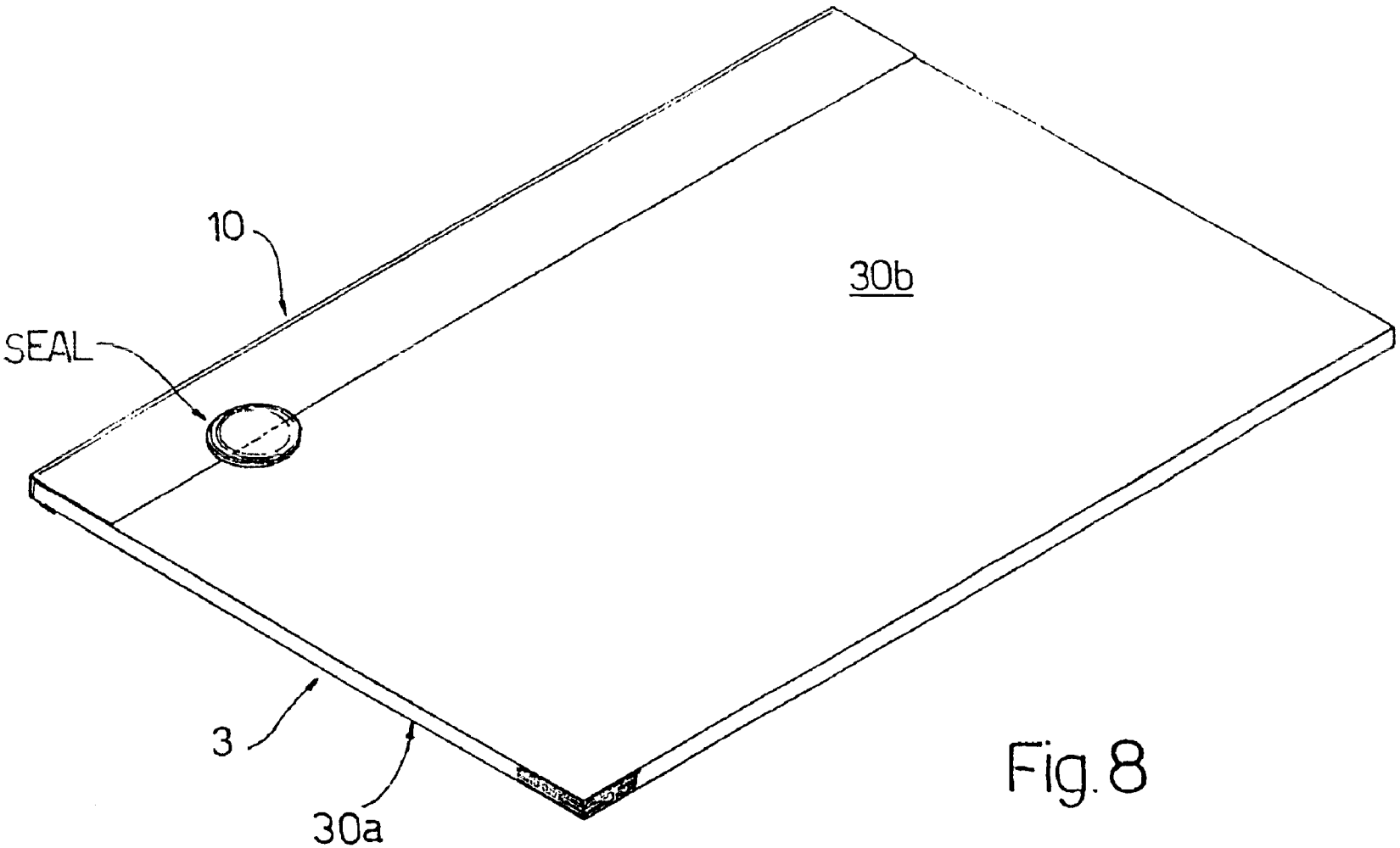
FIG. 8 shows a view in perspective of a bound bundle formed using the FIG. 1 binding device.

Cover strip 20 is removed (FIG. 6) and closing strip 10 is gripped and folded into a C (arrow K, FIGS. 6 and 7) so that the peripheral portion of closing strip 10 adjacent to edge lob is superimposed on flat end element 30*b* defining the second face of pack 30, and adhesive strip 17, with cover strip 20 removed, adheres firmly to the portion of flat element 30*b* close to holes 33, and to the underlying portions of tongues 7. As stated, flat element 30*b* defining the second face of pack 30 is preferably made of sufficiently rigid material, e.g. cardboard or plastic. Adhesive strip 17 thus provides for firmly connecting strip 10 and flat element 30*b,* and so ensuring connection of flat element 30*b* and flat element 3, while the sheets of pack 30 are retained firmly between flat element 30*b* and flat sheet element 3, which respectively define the rear and front cover of a bound bundle (FIG. 8).

The advantages of the present invention will be clear from the foregoing description:

closing strip 10 does not project with respect to the thickness of the bundle, which, being substantially parallel-epipedal with no projecting parts, is therefore easy to shelve or place alongside other bound bundles;

since a portion of each tongue 7 need simply project from the pack of sheets, device 1 may be used for binding packs of sheets of different thicknesses;

writing or printing may be applied to strip 10, the central portion of surface 14 of which defines the spine of the bound bundle;

writing or printing may also be applied to flat sheet element 3 which, depending on the arrangement of the sheets in the bundle, defines the front or rear cover of the bound bundle;

the binding device may be made of recyclable (e.g. paper) material to avoid the necessity of removing the device when disposing of, e.g. burning, the bundle.

Moreover, binding device 1 may be made by simply die-cutting and gluing readily available materials, and is therefore cheap and easy to produce.

The binding device may also be used for security purposes, to prevent sheets from being replaced or added to the bundle, by, for example, initialling or applying a SEAL to the overlapping portion of closing strip 10 and flat end element 30*b* (FIG. 8). In the event the bundle is opened, closing strip 10 is detached from flat end element 30*b,* thus destroying or altering the initialling or the SEAL.

Clearly, changes may be made to the binding device as described and illustrated herein without, however, departing from the scope of the present invention.

What is claimed is:

1. A device for binding sheets in a pack, comprising:

a flat sheet element having, along one side, a number of flexible tongues arranged in a comb-like fashion;

a closing element distinct from the flat sheet element, attached with the sheet element and extending along said side of the flat sheet element; said closing element having an application surface facing said tongues;

said flat sheet element placeable on a first face of said pack to cover said first face, with said tongues inserted inside respective holes formed along an edge of the pack, and with respective ends of the tongues projecting from the holes;

said closing element being foldable and placeable with at least with at least one portion of the application surface superimposed on and firmly connected to a flat element defining a second face of the pack to form a bound bundle.

2. A device as claimed in claim 1, wherein said tongues are integral with said flat sheet element.

3. A device as claimed in claim 1, wherein said tongues are formed integrally with said flat sheet element by die-cutting.

4. A device as claimed in claim 1, wherein said tongues extend along a straight side of said flat sheet element.

5. A device as claimed in claim 1, wherein said flat sheet element has a rectangular perimeter.

6. A device as claimed in claim 1, wherein said closing element has a respective peripheral edge fixed to said flat sheet element along said side.

7. A device as claimed in claim 1, wherein said closing element is rectangular.

8. A device as claimed in claim 1, wherein said closing element has at least one preferential bend line extending in a direction substantially parallel to said side of said flat sheet element.

9. A device as claimed in claim 1, wherein said application surface has at least one portion covered with adhesive.

10. A device as claimed in claim 9, wherein said portion covered with adhesive extends along a peripheral portion of said closing element.

11. A device as claimed in claim 9, wherein said portion covered with adhesive has a removable cover strip.

12. A device as claimed in claim 1, wherein the closing element has a useful width greater than the length of said tongues, so that the end portions of said tongues face said application surface when said closing element is undeformed.

13. A device as claimed in claim 1, wherein each tongue is rectangular with a rounded minor-side free end.

14. A device as claimed in claim 1, wherein said closing element is strip-shaped.

15. A device as claimed in claim 1, wherein said closing element is made of cloth.

16. A bound bundle comprising a binding device and a number of sheets arranged in a pack; wherein said binding device comprises:

a flat sheet element having, along one side, a number of flexible tongues arranged in a comb-like fashion;

a closing element distinct from the flat a sheet element, attached with the sheet element and extending along said side of the flat sheet element; said closing element having an application surface facing said tongues;

said flat sheet element placed on a first face of said pack to cover said first face, with said tongues inserted inside respective holes formed along an edge of the pack, and with respective ends of the tongues projecting from the holes;

said closing element being folded and placed with at least one portion of the application surface superimposed on and firmly connected to a flat element defining a second face of the pack to form said bound bundle.

* * * * *

UNITED STATES PATENT AND TRADEMARK OFFICE

CERTIFICATE OF CORRECTION

PATENT NO. : 6,669,392 B2
DATED : December 30, 2003
INVENTOR(S) : Francesco Rebora It is certified that error appears in the above-identified patent and that said Letters Patent is hereby corrected as shown below:

Column 2,
Line 33, replace “1ob” with -- 10b --.

Column 3,
Line 14, replace “1ob” with -- 10b --.

Column 14,
Line 52, delete “a”.

Signed and Sealed this

Fifteenth Day of February, 2005

JON W. DUDAS
*Director of the United States Patent and Trademark Office*